United States Patent [19]

Collins et al.

[11] Patent Number: 4,752,753

[45] Date of Patent: Jun. 21, 1988

[54] COAXIAL WAVEGUIDE BAND REJECT FILTER

[75] Inventors: Glen E. Collins, Calabasas; Michael A. Claggett, Canoga Park, both of Calif.

[73] Assignee: WAVECOM, Northridge, Calif.

[21] Appl. No.: 903,669

[22] Filed: Sep. 4, 1986

[51] Int. Cl.[4] ..... H01P 1/209; H01P 1/205

[52] U.S. Cl. ..... 333/209; 333/207; 333/212

[58] Field of Search ..... 333/202, 206–212, 333/219, 222–235, 263, 245, 248

[56] References Cited

U.S. PATENT DOCUMENTS 4,460,878 7/1984 Fouillet et al. ..... 333/226

FOREIGN PATENT DOCUMENTS 843341 8/1960 United Kingdom ..... 333/208

*Primary Examiner*—Marvin L. Nussbaum

*Attorney, Agent, or Firm*—Spensley Horn Jubas & Lubitz

[57] ABSTRACT

The present invention relates to a waveguide band reject filter employing TEM coaxial type resonators that partially protrude into the top wall of the waveguide in such a way as to produce a predetermined frequency selective discontinuity. By proper choice of location, number of resonators, resonator configuration and protrusion, a spurious free highly efficient frequency selective band reject filter response can be obtained.

9 Claims, 6 Drawing Sheets

TYPICAL RESPONSE OF WAVEGUIDE BAND REJECT FILTER

INSERTION LOSS OF BAND REJECT FILTER

STOP/PASS BAND TRANSITION

REJECT BAND RESPONSE

RETURN-LOSS (STOPBAND) REGION

RETURN-LOSS 6.7 TO 18.1 GHz —BAND REJECT FILTER

COAXIAL WAVEGUIDE BAND REJECT FILTER

BACKGROUND OF THE INVENTION

1. Field of the Invention

The present invention relates to a waveguide band reject filter employing TEM coaxial type resonators that partially protrude into the top wall of the waveguide in such a way as to produce a predetermined frequency selective discontinuity. By proper choice of location, number of resonators, resonator configuration and protrusion, a spurious free highly efficient frequency selective band reject filter response can be obtained.

2. Description of the Prior Art

Microwave filters are used to provide frequency selectivity, that is, to pass certain frequencies and reject others by means of a group of reactive circuit elements. The prior art of specific interest in this case involves band reject filters that are designed to eliminate a specific frequency band within a much larger spectrum.

Band reject filters may be designed using various techniques that employ, for example, lumped elements with discrete coils and capacitors, stripline, coaxial resonators or waveguide resonators. The present invention to be described operates in a waveguide system, so the discussion of prior art will be confined to waveguide band reject filters.

A waveguide band reject filter consists of a section of waveguide having a direct path from input to output. Individual waveguide resonant cavities are then mounted on the waveguide section and connected to it through iris openings in the waveguide section. FIGS. 1A and 1B illustrate a three resonator waveguide band reject filter where the waveguide resonant cavities are mounted on the broad wall of the main waveguide and coupled to it through iris slots to produce the proper frequency selective discontinuity. FIG. 2 presents the response of this filter showing a rejection notch of greater than 50 dB.

A similar response can also be obtained when double ridge waveguide is used between the input to output ports. The coupling from the rejection resonator to the main guide is obtained by moving the iris coupling slot off center so that it is adjacent to the ridge, i.e., between the ridge and the side wall. The reject resonators are still mounted as shown in FIGS. 1A and B.

Both the standard waveguide and ridge waveguide filters described are very efficient and serve a purpose. However, the resonant waveguide cavities, common to both designs, have a second spurious response that will occur at less than twice the fundamental resonant frequency as shown in FIG. 2. This is explained and expected because the fundamental resonance occurs at a frequency where the waveguide wavelength is ½ wavelength long and the next resonance occurs at a frequency where the waveguide wavelength is one wavelength long.

The wavelength in the waveguide is not a linear function since it approaches infinity when the resonant frequency approaches the cut-off frequency of the waveguide. Thus, the relationship between the first and second resonance in the waveguide can be, say 1.7 to 1 rather the 2.0 to 1. In any case, a second rejection response will occur at somewhat less than twice the desired first response frequency.

In many cases where a reject filter is needed, the added spurious response is of no significance. This is especially true when the spurious rejection falls outside the range of the waveguide. However, where a broad frequency spectrum is required, such as that obtained with ridge waveguide, the spurious rejection notch can fall within the desired pass band. For example, the pass band of a particular ridge waveguide may be 6.5 GHz to 18.0 GHz. Thus, with a notch frequency set at 9.0 GHz, the undesired spurious notch will occur at 15.5 GHz and produce undesired attenuation at that frequency.

The object of this invention is to provide a waveguide band reject filter that has no spurious response occurring within the waveguide frequency range.

SUMMARY OF THE INVENTION

The new waveguide band reject filter, the subject of this invention, employs a coaxial type resonator that provides spurious free performance over the entire ridge waveguide frequency band. The resonator partially protrudes (by the proper amount) into the ridge waveguide through an off-set opening to obtain the desired coupling to the signal passing through the waveguide.

The coaxial resonator is capacitively loaded where it passes through the waveguide opening and additionally loaded with a small "hat" on the end of the resonator.

The fundamental resonance of a grounded coaxial resonator of the present type will occur at one-quarter wavelength and its next spurious response will occur at three-quarter wavelength i.e., three times the desired notch frequency rather than only twice as was discussed for the case of the waveguide cavity resonators. The coaxial capacitive loading described above, further improves this relationship so that the first spurious response occurs at approximately 3.5 times the desired notch frequency.

Thus, no spurious response will occur in a ridge waveguide band reject filter employing coaxial resonators of the present invention when tuned to any frequency in its operating band (e.g. 6.5 GHz 18.0 GHz).

BRIEF DESCRIPTION OF THE DRAWINGS

A detailed description of the invention will be made with reference to the accompanying drawings wherein like numerals designate corresponding parts in the several figures.

FIG. 3A is a side view, FIG. 3B is a top view and FIG. 3C is a cross-sectional view (along the line 3C—3C of FIG. 3B) of a typical embodiment of the invention.

FIG. 5 is the measured insertion loss of the filter across the band 6.7 GHz to 18.1 GHz. This measurement shows that spurious free performance is obtained and that the insertion loss is very low outside of the desired stop band.

FIG. 6 provides additional insertion loss detail in the immediate region of the stop band.

FIG. 7 shows detail of the depth and width of the notch, i.e., the 60 dB bandwidth is 0.22 GHz wide with the depth extending to greater than 80 dB.

FIG. 8 illustrates measurement data regarding the return loss in the immediate region adjacent the stop band. A return loss of 14 dB is equivalent to a VSWR of 1.5 to 1.

FIG. 9 shows the return loss of the complete band of interest that further confirms the response of FIG. 5 showing that there are no spurious responses below the upper band of interest, i.e., 18.1 GHz.

DESCRIPTION OF THE PREFERRED EMBODIMENTS

The following detailed description is of the best presently contemplated modes of carrying out the invention. This description is not to be taken in a limiting sense, but is made merely for the purpose of illustration of the general principles of the invention since the scope of the invention is best defined by the appended claims.

Non-ridged waveguide used from many applications has a limited frequency range of operation. For example, X-band WR-90 waveguide has a good operating frequency range of 8.0 to 12.4 GHz. Its upper frequency range of operation is limited because the second mode (undesired) can occur at 13.4 GHz where its use is not possible.

Single and double ridge waveguide was then developed to improve the operating frequency range of waveguide. By placing a ridge of the proper dimensions in the center of the guide, the low frequency cut-off can be lowered because of the capacitive loading effect and the upper range is also increased since the second resonance is moved higher by the presence and location of the capacitive loading.

Figure 1A:
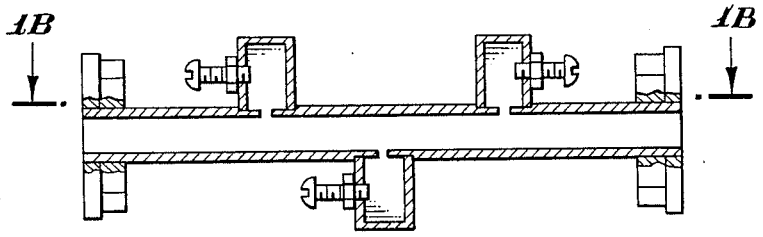
FIG. 1A PRIOR ART
FIGS. 1A and 1B show the mechanical layout and dimensions for a standard waveguide band reject filter having three resonators coupled to the main inputoutput waveguide via small iris slots in the top wall of the waveguide. The tuning screws mounted in the waveguide resonant cavities are used to synchronous tune the three cavities to the desired rejection frequency.
Figure 1B:
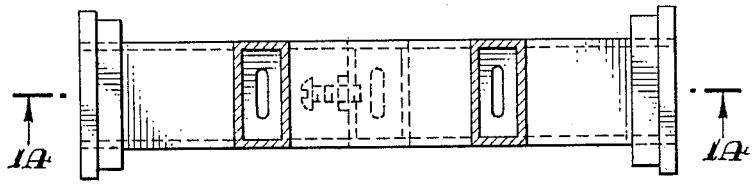
FIG. 1B PRIOR ART
Figure 2:
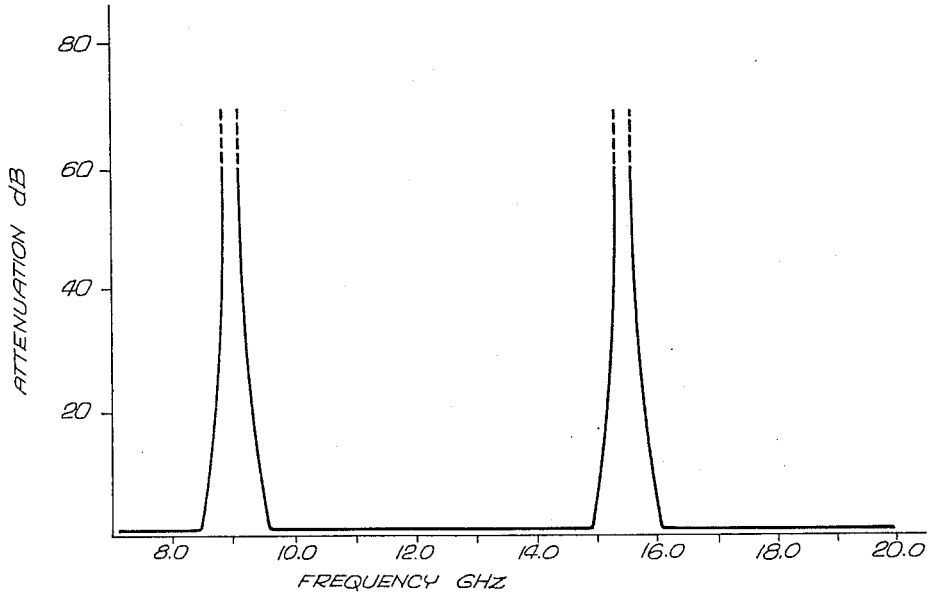
FIG. 2 PRIOR ART
FIG. 2 illustrates the response of the band reject filter described in FIG. 1. It should be noted that the undesired second rejection occurs at approximately 15.5 GHz with the desired rejection band occurring at 9.0 GHz, in this example.

With the general use of ridge waveguide for high power aircraft radar systems, the undesired spurious response produced by the filter described in FIGS. 1A and 1B and illustrated in FIG. 2 is often unacceptable. An alternate solution would be to use a strip-line or coaxial reject filter (coaxial input and output connectors). If waveguide input and output is required, then transitions to waveguide could be employed. However, if the later approach is taken, it will result in a relatively large insertion loss in the desired bands which is most often not acceptable. The structure is also generally very power limited.

Figure 3A:
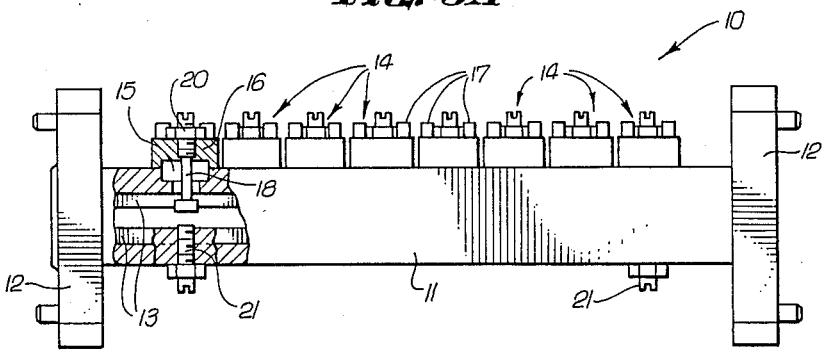
FIGS. 3A, 3B and 3C provide a mechanical layout of the new invention employing eight coaxial resonators where the coaxial resonators are mounted as shown in the cut-away. Tuning is accomplished by adjusting the length of the coaxial element that protrudes through the waveguide wall opening.
Figure 5:
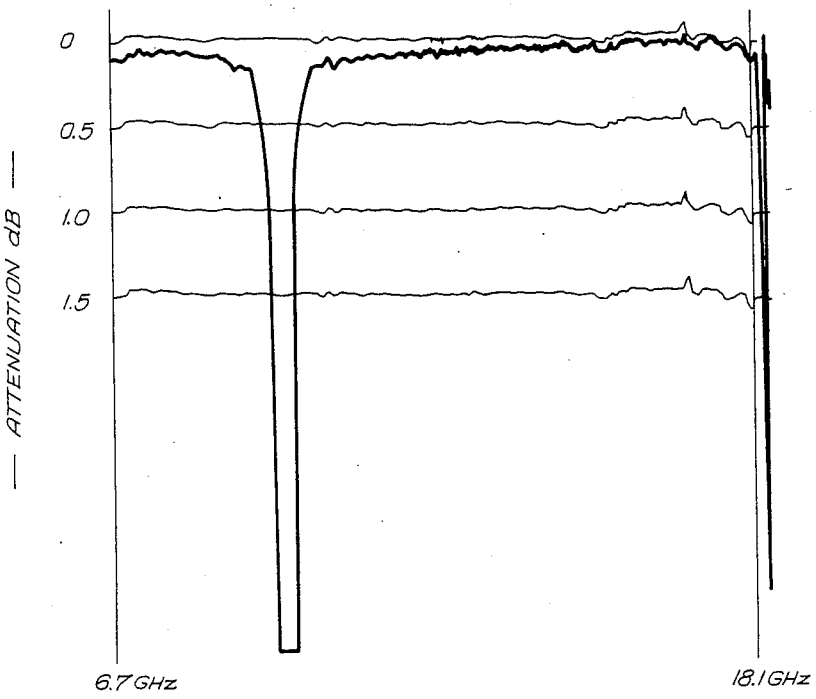
FIGS. 5 through 9 provide measurement data of the new ridge waveguide band reject filter with the coaxial resonators tuned to 9.4 GHz.
Figure 6:
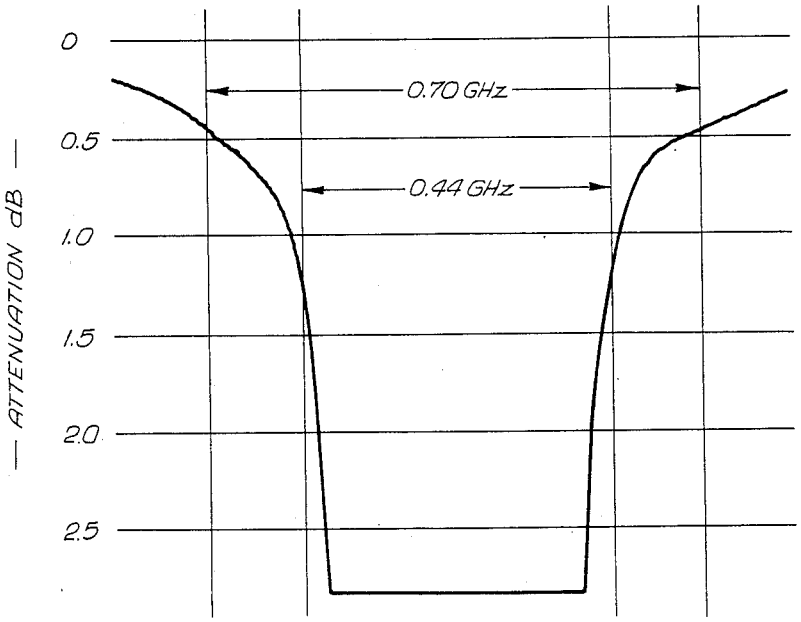
Figure 7:
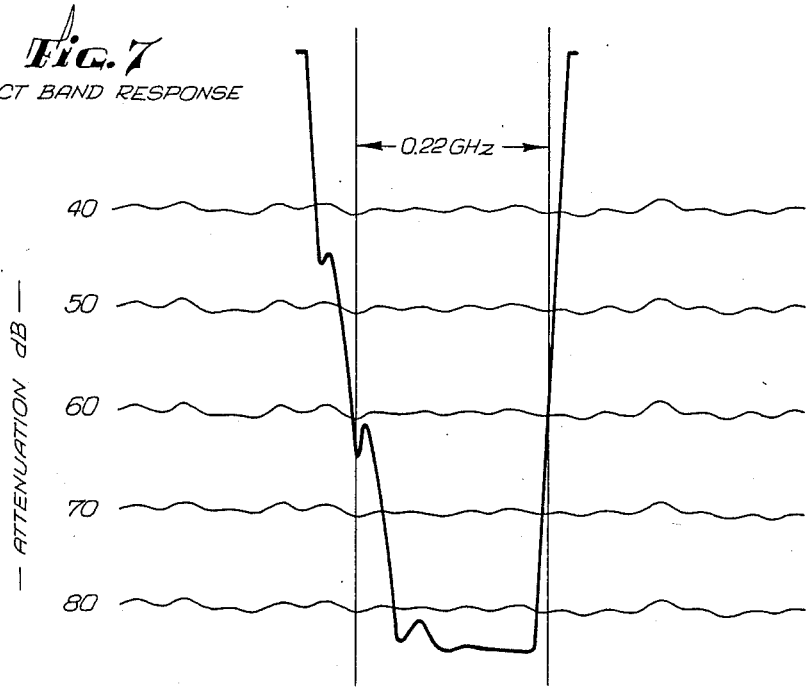
Figure 8:
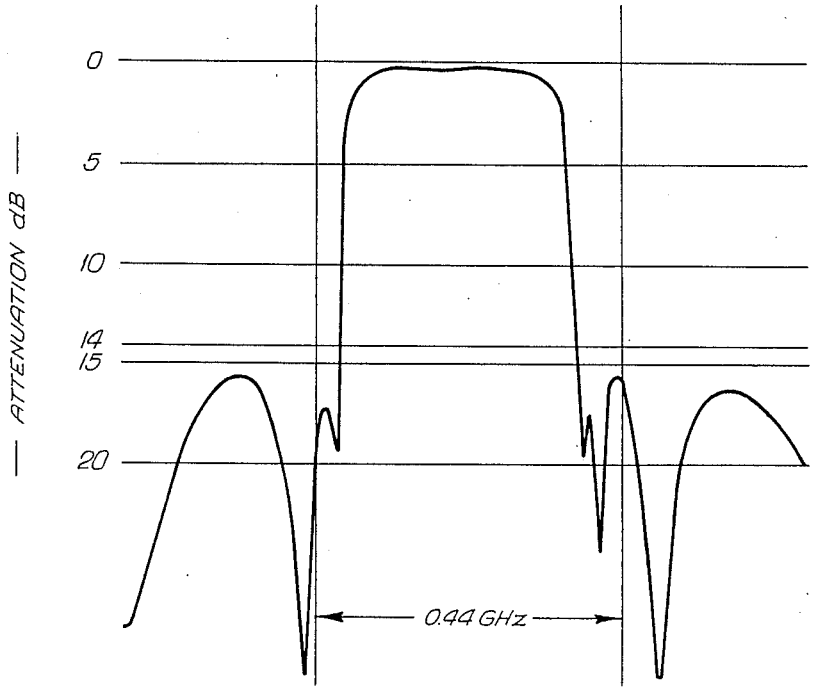
Figure 9:
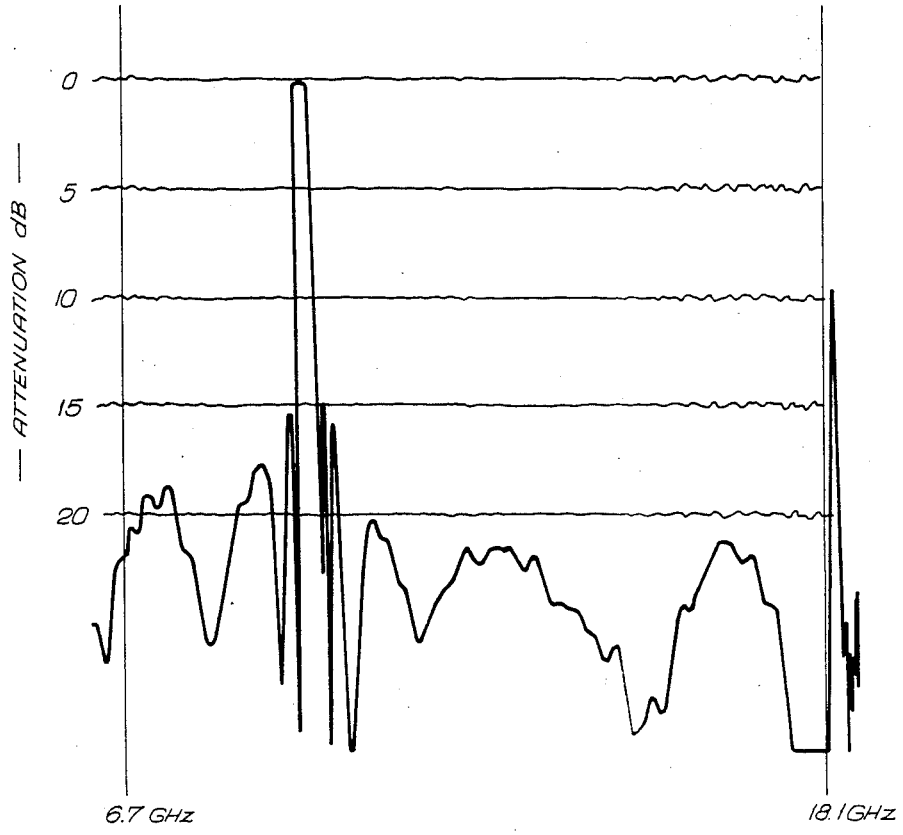

The invention, as shown in FIGS. 3A, B, C and 4A, B, employs ridge waveguide that may be inserted directly in the wave guide run between the radar transmitter/receiver and the antenna. The insertion loss, as shown in FIG. 5, is typically 0.2 dB over much of the band, a very low value. Likewise the other performance features as shown in FIGS. 6 through 9 are very compatible with radar systems.

A mechanical description of an illustrative embodiment of the invention is as follows. The waveguide reject filter 10 is housed (FIGS. 3A and 3B) in a section of ridge waveguide 11 having flanges 12 on either end. Top and bottom ridges 13 provide the loading previously discussed.

Figure 3B:
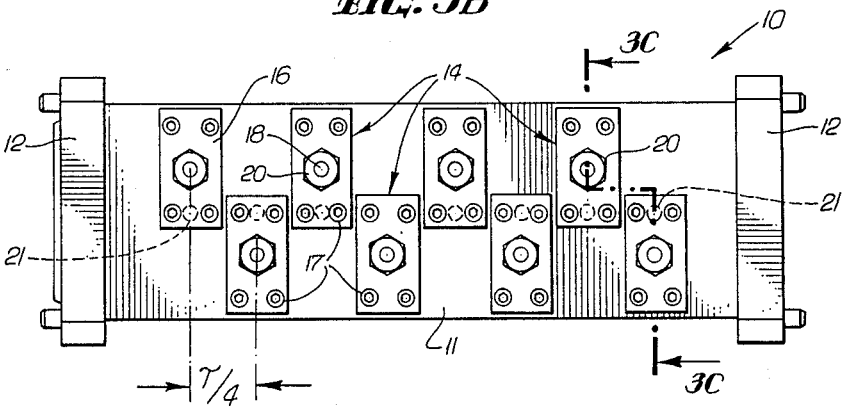

In the embodiment of FIGS. 3A and 3B, eight resonators 14 are employed. However, the number of such resonators is a design choice, and the invention will work with even a single resonator. In general, the depth and width (i.e., the attenuation and bandwidth) of the desired rejection band will be determined by how many resonators are employed.

For ease of fabrication, in the illustrated embodiment the resonators 14 are situated alternately on opposite sides of the ridge 13. However, each such resonator will be effective regardless of which side of ridge it is located at. Advantageously, but not necessarily, successive such resonators are spaced (with respect to the longitudinal axis of the waveguide) by about one-quarter wavelength of the reject frequency. This is indicated in FIG. 3B. Thus in this embodiment there are eight resonators 14, effectively spaced along the axis of the waveguide 11 at intervals of one-quarter wavelength.

Figure 3C:
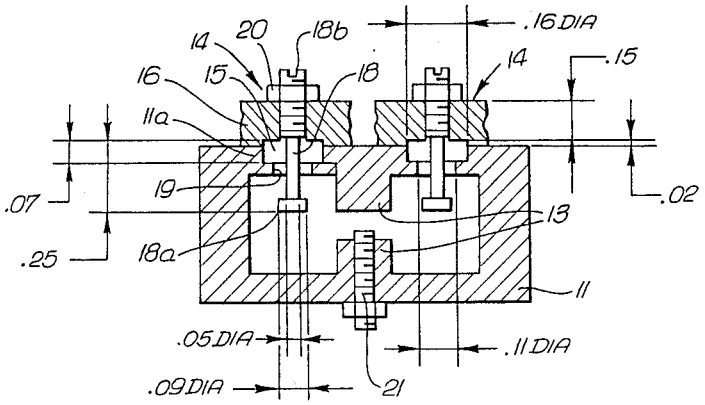
Figure 4B:
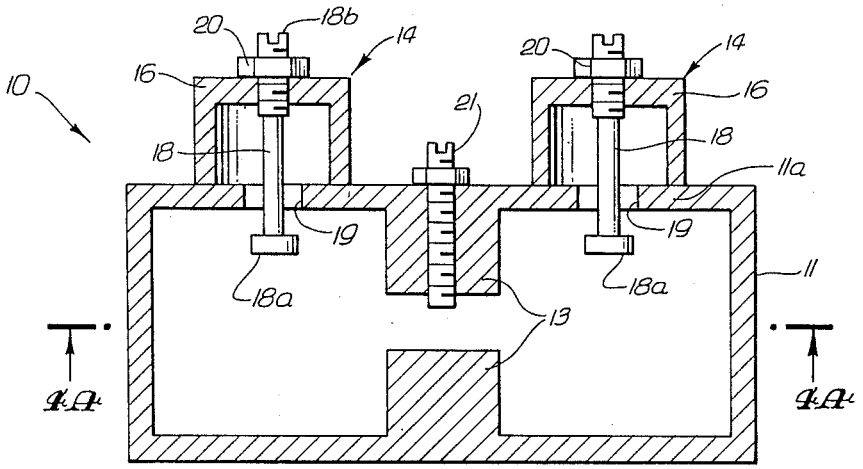
FIGS. 4A and 4B provide a more detailed view (not to scale) of the coaxial resonator and its relationship to the waveguide structure. Note the coaxial cavity outside the waveguide, also the resonator protrusion through the waveguide and the loading "hat" on the end of the resonator.
Figure 4A:
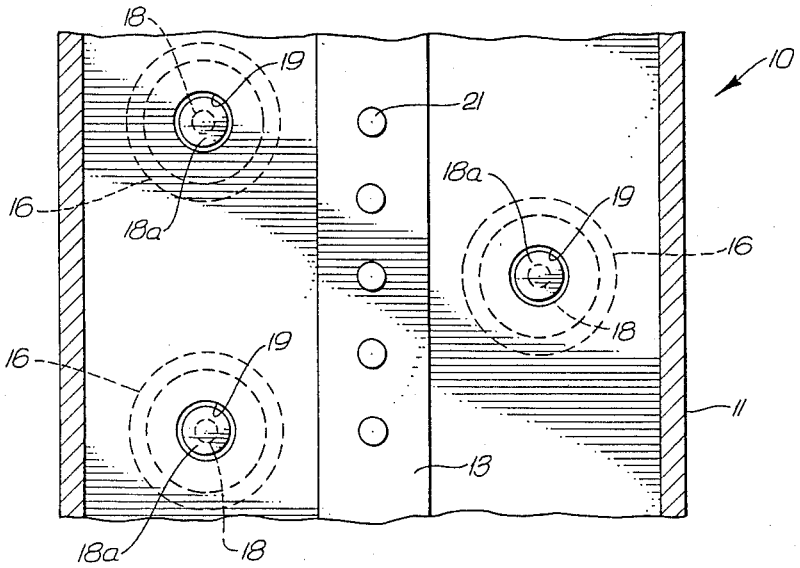

Each resonator 14 comprises a hollow cylindrical cavity 15. In the embodiment of FIGS. 3A–3C, this cavity 15 is partly milled into the waveguide 11 itself, and partly milled into a rectangular block 16 that is fastened to the top of waveguide 11 by appropriate bolts 17. While such construction is convenient, the invention is not limited to this particular manner of fabricating the resonator cavity.

Each coaxial resonator 14 includes a rod-like coaxial element 18 which extends through the cavity 15 and through an opening 19 in the top wall 11*a* of the waveguide 11. The bottom end of the element 18 is provided with a cap or capacitive loading hat 18*a* situated within the waveguide 11. The upper end 18*b* of the coaxial element 18 is threaded for mounting within a corresponding threaded hole at the top of the block 16. The end 18*b* is slotted to permit adjustment of the distance which the hat 18*a* protrudes into the waveguide 11. The element 18 is locked in place by a nut 20.

The frequency of the coaxial resonator 14 is determined by various dimensions including the diameter of the cavity 15, the diameters of the coaxial element 18 and the hat 18*a*, the size of the opening 19, and the amount of protrusion of the coaxial element 18 into the waveguide 11. Such protrusion distance can be adjusted by rotating the threaded end 18*b* of the coaxial element 18, thereby facilitating easy fine tuning of the reject filter. The amount of protrusion also has an effect on the bandwidth, i.e., on the width of the rejection notch. In general, the further the protrusion of the hat 18*a* into the waveguide 11, the wider will be the notch.

Advantageously, but not necessarily, the ratio between the inside diameter of the cavity 15 and the diameter of the coaxial element 18 is about 3:1 or 4:1.

FIG. 3C shows typical dimensions for a waveguide band reject filter in accordance with the present invention, and designed for operation in the 6.5 GHz to 18 GHz range, with a nominal reject frequency of 9.4 GHz. This rejection frequency typically can be adjusted in the range of say 9.3 GHz to 9.5 GHz by varying the protrusion distance of the coaxial element 18 by turning the threaded end 18*b* thereof.

Within the waveguide 11, each resonator 14 essentially "looks like" a short circuit to a wave at the reject frequency which is propagating down the waveguide 11. In effect, the energy of such wave is reflected back toward the source as a result of the presence of the coaxial resonator.

Minor adjustments to improve the return loss are sometimes needed. This is accomplished using threaded adjustment screws 21 projecting through the ridge 13 into the waveguide 11.

In an alternative embodiment (not shown), solenoids or other mechanical arrangement may be provided to pull the coaxial elements 18 upward so that they do not protrude into the waveguide 11. When so withdrawn, the reject filter 14 is ineffective. In other words, the reject filter 14 can be switched into and out of the circuit by selectively withdrawing or reinserting the coaxial element 18 into a protruding relationship within the waveguide 11.

We claim:

1. A band reject filter for a waveguide, comprising:

at least one coaxial resonator having an outer element and an inner coaxial element, said outer element being mounted to a wall of said waveguide and said inner coaxial element adjustably protruding into the interior of said waveguide.

2. A filter according to claim 1 further including:

means for selectively withdrawing said coaxial element from protrusion into said waveguide interior, thereby negating the effectiveness of said coaxial resonator.

3. A filter according to claim 1 wherein said at least one coaxial resonator includes a cavity formed at least in part within a block that is affixed to the exterior of said waveguide.

4. A filter according to claim 1 wherein said inner coaxial element is at least partially threaded to permit screw-type adjustment of said depth of protrusion.

5. A filter according to claim 1 wherein said inner coaxial element has a capacitive loading hat at the end which protrudes within said waveguide.

6. A band reject filter for a waveguide oomprising:

at least one coaxial resonator mounted to a wall of said waveguide and having a coaxial element protruding into the interior of said waveguide, said waveguide being a ridge waveguide, and wherein said at least one coaxial resonator is mounted between the ridge and a sidewall of said waveguide.

7. A filter according to claim 6 wherein plural coaxial resonators are provided, alternate ones of said coaxial resonators being mounted on opposite sides of said ridge.

8. A ridge waveguide band reject filter comprising:

a plurality of TEM type resonators having an outer element and an inner element, said outer element being mounted on a wall of said ridge waveguide, alternative ones of said resonators being situated on opposite sides of said ridge, each resonator inner element protruding into the interior of said waveguide to a depth selected to provide a desired reject notch frequency.

9. A method for establishing selective band reject characteristics of a waveguide, comprising:

providing at least one coaxial resonator having an outer element and an adjustably protrudable inner element, said outer element being positioned in a wall of said waveguide, selecting the location and resonator configuration and adjusting said protrusion depth into said waveguide to establish a desired reject notch frequency and notch bandwidth, whereby said waveguide has a spurious response frequency occurring at least three times said desired notch frequency.

* * * * *